United States Patent [19]

McGahey

[11] 4,082,122

[45] Apr. 4, 1978

[54] CLOSED FUEL SYSTEM WITH VACUUM ASSIST

[75] Inventor: Dean C. McGahey, Fishkill, N.Y.

[73] Assignee: Texaco Inc., New York, N.Y.

[21] Appl. No.: 733,819

[22] Filed: Oct. 19, 1976

[51] Int. Cl.[2] ..... B65B 3/04
[52] U.S. Cl. ..... 141/5; 141/59
[58] Field of Search ..... 141/4–8, 141/37–67, 285–290, 301–303

[56] References Cited

U.S. PATENT DOCUMENTS

| | | | |
|---|---|---|---|
| 3,181,729 | 5/1965 | Milonas et al. | 141/290 |
| 3,850,208 | 11/1974 | Hamilton | 141/290 |
| 3,907,010 | 9/1975 | Burtis et al. | 141/59 |

*Primary Examiner*—Houston S. Bell
*Attorney, Agent, or Firm*—Thomas H. Whaley; Carl G. Ries; Robert B. Burns

[57] ABSTRACT

A balanced system for transferring a volatile liquid fuel into a tank therefor, while avoiding passage of fuel vapors into the atmosphere. Vacuum assist means is further provided to assure a tight fit between a removable fuel dispensing nozzle and the tank filler tube.

9 Claims, 2 Drawing Figures

CLOSED FUEL SYSTEM WITH VACUUM ASSIST

BACKGROUND OF THE INVENTION

During the transfer of a volatile liquid such as gasoline or a similar fuel from a storage facility, there is normally an unsealed connection made between the disconnectable nozzle and the tank being filled. As the transfer operation progresses, residual gases contained in the tank, as well as air, normally rise into the atmosphere.

Many municipalities and governmental agencies have proposed or adopted regulations intended to reduce or at least control these emissions. One method toward complying with mandated regulations is the provision of a completely closed system between the fuel source or storage facility and the tank being filled.

Such a closed system normally includes a conduit which carries fuel, to the remote end of which a manually operated dispensing nozzle is attached. The latter is adapted to be removably positioned in the filler pipe of the receiving tank, and includes means to form a sealed engagement between the nozzle spout and the tank filler tube.

Also in many instances, the system is not closed but rather is vented to the atmosphere. With such an arrangement, as liquid is pumped out either of two eventualities could occur. If fuel leaving the system is not immediately replaced by vapor from the tank being filled, air will be drawn into the system. On the other hand, when excessive vapors are drawn in from the tank being filled, some will have to be vented.

Several embodiments of sealing arrangements have been found to be advantageous for providing the necessary vapor tight, yet disconnectable connection at the nozzle spout. One method for providing the desired seal, is to attach a cylindrical, flexible walled member such as a rubber boot or the like, to the fuel dispensing nozzle. The boot in such a position will substantially surround the nozzle spout when the latter is in place. By use of such an arrangement, when the nozzle is received in the filler pipe of the receiving tank, the walls of the flexible boot will be deflected and/or distorted. The boot will thereby define an annular vapor passage while the resilient contact edge thereof sealably engages the tank filler pipe.

This type of arrangement has generally been found to be highly effective. Thus, when a fuel flow is introduced from the nozzle into the receiving tank, a slight pressure is produced within the tank to displace fuel vapors as well as air. These vapors will be urged upwardly through the annulus defined by the nozzle spout and the flexible member. Said vapors can then be transferred by way of the dispensing nozzle through a separate conduit to the fuel source, or to another reservoir for retaining the vapors.

The effectiveness of this system depends to a large degree on the mechanical compatibility of the vehicle with the nozzle, to permit a tight seal at their interface. If for any reason the contact edge of the nozzle boot cannot engage the filler pipe, a seal cannot be achieved, and a leak will result or develop.

Another potential source of vapor leakage is through the above noted tank vents, which are present on some vehicles, particularly those manufactured prior to 1971. When a leak path does develop, some of the vapor from the tank can be emitted to the atmosphere.

In conjunction with closed fuel systems, vacuum assist means have been devised which cause the vapor collection system to operate under a slight vacuum. This tends to pull air into the system through any leak paths which exist or develop. It also tends to inhibit the flow of vapor to the atmosphere. Vacuum assist facilities however often embody the disadvantage of bringing in excessive amounts of air which could produce an undesired mixture in the vapor space. Further, they could produce excessive vent pipe emissons due to the saturation of the excess air as it passes through the system in contact with gasoline.

In the presently disclosed arrangement, a system is provided which incorporates a number of features which include (1) a tight seal at the vehicle-nozzle interface for those vehicles which permit it, (2) a vacuum assist device adapted to aid in collecting vapors from those vehicles which cannot be sealed, (3) the use of a positive displacement hydraulic motor which is driven by the dispensed gasoline flow. Said motor drives a positive displacement vapor pump thereby controlling the volume of vapor pumped in relation to the volume of gasoline dispensed and further limiting the pumping period to the interval when gasoline is being dispensed, and (4) a valved bypass conduit which limits the build-up of a positive or negative pressure, which can be imposed on the vapor space between the vehicle tank and the vapor pump.

Toward assuring the operation of the overall system under varying circumstances, a valved bypass conduit is provided across the positive displacement vapor pump to bypass vapors either to or from the pump suction side.

An object of the invention therefore is to provide a fuel system which embodies an effective sealing means disposed between the fuel dispensing nozzle and a receiving tank. A further object is to provide a balanced fuel system of the type contemplated which is enhanced in response to the inflow of fuel to the receiving tank. A still further object is to provide a vacuum assist arrangement within a fuel system having a dispensing nozzle, which assistance is adjusted in response to the flow of gasoline to the tank and to the volume of vapor which is displaced from the tank during the operation.

DESCRIPTION OF THE DRAWINGS

In the drawings,

FIG. 1 is an environmental arrangement of the presently disclosed closed fuel system which connects an underground storage tank with a receiving tank to be filled, such as would be contained on an automobile, boat or the like.

Figure 1:
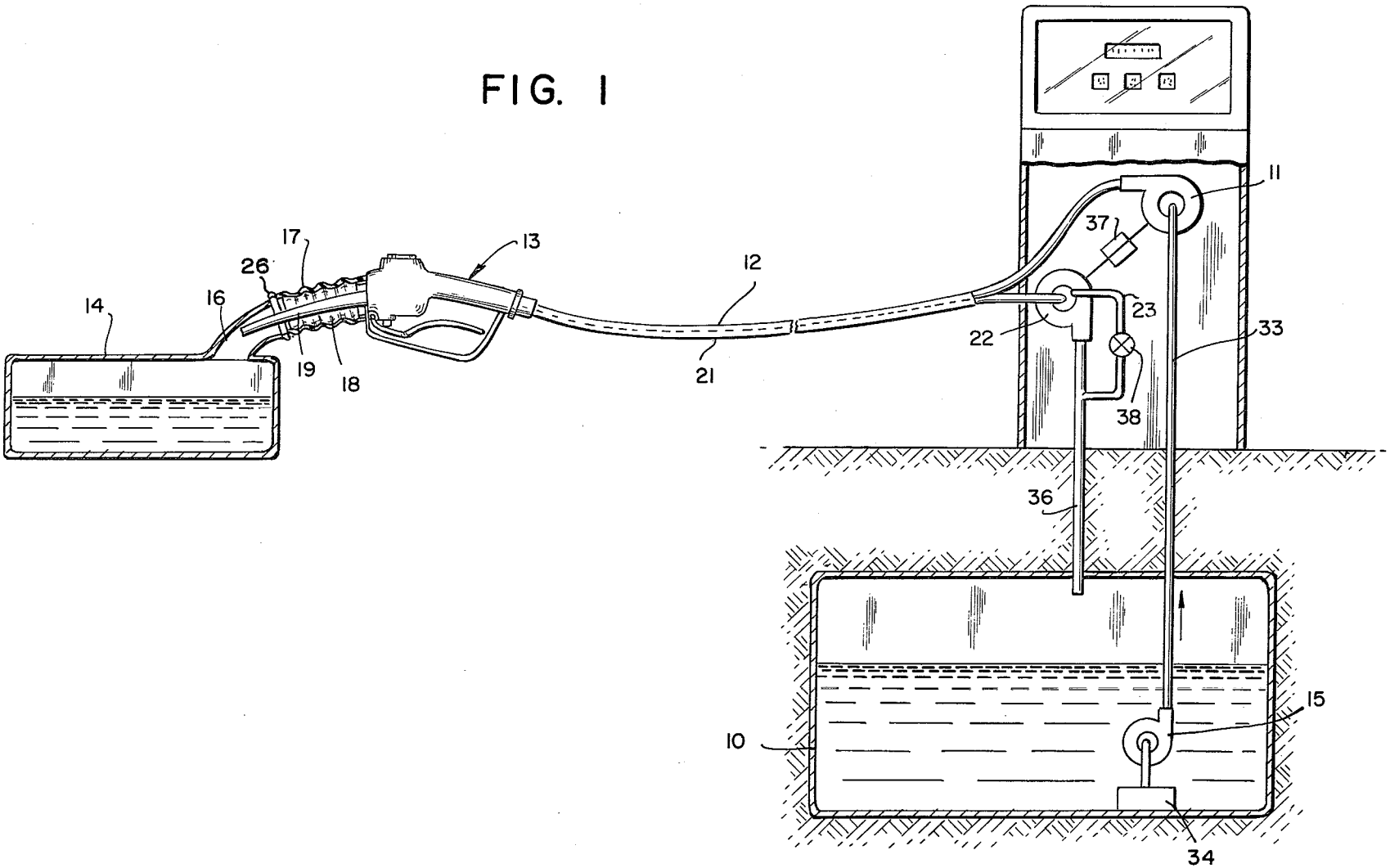
Figure 2:
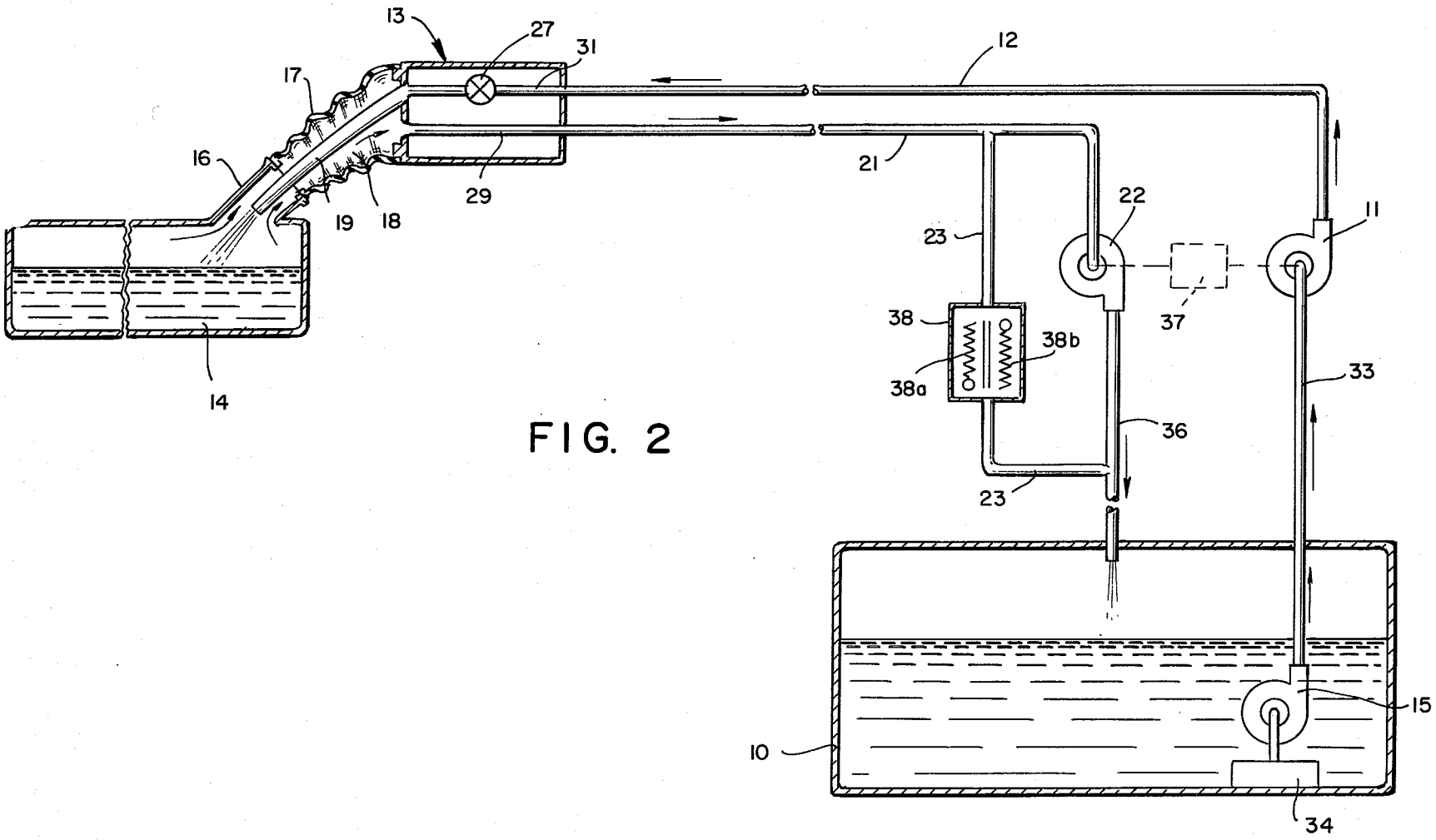
FIG. 2 is similar to FIG. 1, illustrating certain parts of the systems schematically to show the internal working parts thereof.

The invention in brief, and referring to the drawings, the overall system is shown in FIG. 1 wherein a fuel storage tank 10 of the type normally found in a service station is provided with an electrically driven gasoline supply pump 15 adapted to be actuated for removing a stream of gasoline or similar volatile liquid. Said pump can be either at the ground level, or as shown, submerged in the fuel.

Pump 15 discharges by way of conduit 33 into the inlet port of a hydraulic motor 11. The latter is in turn communicated through an elongated conduit 12 by way of a dispensing nozzle 13, to a fuel tank 14 having a filler pipe 16. When nozzle 13 is engaged with filler pipe 16, a resilient walled boot 17 is deformed to define an annular passage or chamber 18 between the boot itself, and the inwardly disposed nozzle spout 19.

During a fuel transfer operation, as fuel is discharged through hydraulic motor 11 to nozzle 13, a return flow of vapor by way of a second conduit 21 is enhanced by a vapor pump 22. The latter is driven through a direct connection, or a suitable transmission means between the hydraulic motor 11 and the vapor pump 22. Thus, passage of fuel to tank 14 in effect initiates the flow of the vapor from said tank.

A valved bypass conduit 23 communicates the suction side of vapor pump 22 with the discharge thereof. Said valved bypass 23 functions to regulate the vapor pressure. For example, when a tight nozzle seal exists at boot 17, and vapor volume from tank 18 exceeds the displacement capability of vapor pump 22, a portion of the vapor bypasses said pump 22, to limit the system pressure. When on the other hand, vapor volume is less than pump 22 displacement, sufficient vapor is recycled from the discharge to the suction of the pump whereby to limit the vacuum created in tank 14.

More specifically, and as mentioned, receiving tank 14 being filled is normally of the type found on an automobile or a boat wherein the liquid is held within either an enclosed, or a vented container. The latter is usually provided with one or more filler pipes 16 which extend from the tank a predetermined distance. Filler pipe 16 is normally provided with a vented cap, not shown, which arrangement permits only a limited accumulation of vapors within the fuel tank 14.

This type of system would avoid an excessive build-up of vapor pressure, particularly under warm weather conditions. Filler pipe 16 can be curved, or straight as presently shown. It may further be of the type adapted to accommodate only unleaded fuel as is presently found in many vehicles. The inlet end of filler pipe 16 can be provided with a lip 26 normally conformed to receive the engaging surface of the vented filler cap.

Fuel dispensing nozzle 13 is of the type normally utilized by the industry at service stations, and is manually operable to commence a fuel flow. It further includes means for automatically discontinuing the flow. The latter is achieved by providing pressure sensitive means within the nozzle itself to close the main flow control valve 27 at such time as fuel tank 14 becomes filled, or when an excessive pressure builds up within the fuel system.

Physically, dispensing nozzle 13 includes an elongated body 28 which functions as a handle for manipulating the nozzle. Said body is provided with a plurality of internal passages 29 and 31 for carrying liquid into receiving tank 14 by way of conduit 12. Similarly, it carries vapors away from tank 14 for return to storage tank 10.

Body 28 is further provided at the rear end with a connection for engaging elongated fuel carrying conduit 12 as well as for engaging vapor carrying conduit 12. The remote end of body 28 is provided with extended spout 19 which communicates with internal fuel passage 31. Said spout 19 is of sufficient length to be received into tank filler pipe 16 prior to a fuel transfer operation. Spout 19 also includes means to fixedly engage the filler pipe, such as an external ring or the like. Thus, subsequent to the nozzle being inserted, it will be maintained in place.

Nozzle body 28 is further provided at the spout end with elongated, resilient walled boot 17. The latter in one form comprises a bellows shaped rubber member having sufficiently flexible walls that they can deform in response to pressure applied thereto. One end of cylindrical boot 17 sealably depends from nozzle body 28. The boot other end is opened, and provided with a sufficiently resilient lip to sealably engage the outer surface of filler pipe 16.

When properly positioned, resilient walled boot 17 defines an annular chamber 18 about spout 19. Boot 17 further forms an enclosure into which vapor passage 29 opens such that vapor, which is received in the annular chamber from fuel tank 14, can be directed to storage tank 10.

The fuel storage means, as is the instance of most automotive service stations, comprises primarily one or more submerged storage tanks 10 which are periodically filled by a tanker, truck or other supply vehicle. Electrically powered pump, which as noted herein is positioned above ground level within pumping enclosure 32, or submerged in tank 10, is provided with a suction side which is provided with a filler 34 at the tank floor, or other means for filtering fuel prior to its passing upwardly. The discharge of said gasoline pump 15 is communicated with an elongated fuel riser pipe 33, to hydraulic motor 11. Said motor 11 as mentioned is of the positive displacement type, and driven by the flow of gasoline from tank 10.

Gasoline pump 15 is controlled by a lever actuated switch or similar operating means positioned external to enclosure 32 such that the pumping action can be readily commenced for a filling operation. The discharge side of hydraulic motor 11 is communicated with elongated flexible fuel conduit 21, which is communicated to body 28 of dispensing nozzle 13.

Vapor pump 22 includes a discharge side which is communicated through conduit 36 with storage tank 10. The latter, although presently noted as being positioned underground, can of course be positioned above ground. This however would tend to prompt severe variations in the vapor pressure within the tank 10 as a result of ambient temperature changes.

The vapor pump 22 is communicated by a connecting shaft or similar coupling 37 with hydraulic motor 11. Pump 22 is thus powered by motor 11 to withdraw fuel vapors and air from the fuel tank 14 concurrently with the introduction of liquid fuel to the latter.

As shown, vapor carrying conduit 21 communicates the inlet or suction side of pump 22 with dispensing nozzle 13 adjacent to fuel carrying conduit 12. Said respective conduits 12 and 21 need not be positioned as shown in order that the invention may function as described. Rather, they can be separately disposed or conveniently arranged to achieve the desired purpose of the invention.

Under the normal circumstances as liquid fuel is introduced to fuel tank 14, the rising liquid will displace any fuel vapor and air contained in the tank. Said vapors will include an amount of air in varying proportions depending on the ambient temperature, whether or not the tank is vented, as well as other factors. It should be appreciated that the amount of liquid fuel transferred to tank 14 from tank 10, to the vapor which is transferred to tank 10, will not always be a constant proportion.

Actually the ratio of vapor to liquid will vary considerably depending on temperature and related circumstances. In any event, this ratio will normally be less than unity. The consequences are that stabilizing of the fuel system by either the ingestion of air or the discharge of fuel is required. As fuel vapors are displaced through filler pipe 16, they will enter annular chamber 18. The vapors will pass thereafter to the nozzle 13 by way of the latter's vapor return passage 29.

Operationally, pump 22 will function to establish a positive flow of vapor from annular chamber 18. The latter will thus be maintained under a reduced pressure. Consequently, atmospheric pressure bearing against the nozzle to filler tube joint will tend to form a firm vapor tight connection.

Toward maintaining a degree of vacuum assist with chamber 18, and to stabilize or balance the fuel system regardless of the amount of vapor which is withdrawn from tank 14 during a filling operation, pump 22 is provided with bypass conduit 23. The latter in effect communicates the pump 22 inlet or suction side with the outlet or discharge side. However, flow control valve 38 disposed within conduit 23 functions in two ways.

First, in the instance of an excessively high level of pressure in chamber 18, due to excessive fuel vapor in tank 14, valve **38*a* will open. Since pump 22 will handle only so much vapor as its positive displacement will permit, excessive vapor will flow around the pump by way of valve 38*a* and pass directly into tank 10. This form of relief for pump 22 will permit the latter to maintain the limited pressure level within chamber 18. Further, it disposes of all vapor which is forced from tank 14**.

On the other hand whether the fuel system be either closed or vented, when the vapor pressure at chamber 18 drops below a desired level during a tank filling operation, pump 22 will continue to operate as driven by hydraulic motor 11. Since the flow of vapor from tank 14 will be less than the displacement of pump 22, valve **38*b* will be actuated to open, and valve 38*a* will remain closed. This valve action will cause a recycling of vapor from the pump 22 discharge, back to the pump 22** suction side. Here again, the fuel system will be stabilized, and the reduced pressure at the nozzle-filler pipe connection will be maintained.

It is seen from the foregoing that during a fuel tank filling operation the system will be substantially balanced. Further, the degree of vacuum within the system can be enhanced. Actuation of pump 22 concomitant with the entry of fuel to tank 14 will effectively regulate and stabilize the entire fuel system whereby to minimize the need to maintain a system balance by passage of vapor to or from the system. Thus, in a vented fuel system vapor emissions will be minimized and in a closed system a constant condition will be maintained.

Physically, the connected vapor pump 22 and hydraulic motor 11 are preferably sufficiently close to be conveniently connected. As a matter of convenience said two members can readily be disposed in an enclosure ancillary or adjacent to the main pumping structure. However, and as shown in FIG. 1, the pump-motor assembly can also be incorporated into the body of the structure together with equipment now normally used therein.

Other modifications and variations of the invention as hereinbefore set forth can be made without departing from the spirit and scope thereof, and therefore, only such limitations should be imposed as are indicated in the appended claims.

I claim:

1. In a closed fuel system for conducting vaporizable liquid fuel from a source thereof including a storage tank, into a receiving fuel tank having a filler pipe, and for concurrently conducting a stream of vapor from said receiving tank to said storage tank during a fuel transfer operation, whereby to stabilize the closed system, a fuel dispensing nozzle removably connected with said tank filler pipe, a hydraulic motor having an inlet communicated with said fuel storage tank to receive a stream of liquid fuel therefrom, and having a discharge port communicated with said dispensing nozzle, a vapor pump having an inlet port communicated with said fuel receiving tank to receive vapors displaced therefrom as liquid fuel enters said receiving tank, and having a discharge port communicated with said storage tank, and a valved passage means communicated with said pump inlet and discharge ports respectively to permit a controlled vaporous flow through said passage means.

2. In the system as defined in claim 1, including a resilient sealing element depending from said dispensing nozzle defining a flexible walled closed chamber when said nozzle is disposed in sealing engagement with said receiving tank filler pipe.

3. In the system as defined in claim 2, wherein said vapor pump inlet is communicated with said flexible walled chamber.

4. In the system as defined in claim 1, wherein said bypass conduit includes check valve means therein to regulate vapor flow through said conduit means in response to a pressure condition within the system.

5. In the system as defined in claim 4, including at least two valve means disposed within said bypass conduit, each valve being operable to regulate a flow of fluid passing through each of said valves in opposite directions.

6. In the system as defined in claim 4, wherein said bypass conduit includes automatic valve means disposed therein being automatically operable in response to a pressure condition within the system to regulate the flow of fluid passing through said bypass conduit means.

7. In the system as defined in claim 6, wherein said valve means is operable in response to a predetermined pressure variation at the pump inlet port to regulate vapor flow passing through the pump.

8. Method for avoiding vapor emissions from a fuel system which passes a volatile liquid from a storage tank therefor, to a receiving tank, and which includes a dispensing nozzle adapted to engage and register in said receiving tank, which method includes the steps of;

sequentially passing a stream of said volatile liquid through a hydraulic motor at said receiving tank, concurrently introducing a flow of vapor from said receiving tank to a vapor pump, and connecting said vapor pump to said hydraulic motor whereby to drive said pump.

9. In the method as defined in claim 8, including the step of bypassing at least a part of said vapor flow around said vapor pump.

* * * * *

Disclaimer 4,082,122.—*Dean C. McGahey*, Fishkill, N.Y. CLOSED FUEL SYSTEM WITH VACUUM ASSIST. Patent dated Apr. 4, 1978. Disclaimer filed Feb. 15, 1980, by the assignee, *Texaco Inc.*

Hereby enters this disclaimer to claim 8 of said patent.

[*Official Gazette, June 17, 1980.*]